US006874604B2

(12) United States Patent
Miller et al.

(10) Patent No.: US 6,874,604 B2
(45) Date of Patent: Apr. 5, 2005

(54) ADJUSTABLE LUGGAGE HANDLE SYSTEM WITH LOCKING PIN

(75) Inventors: Jacqueline N. Miller, Boca Raton, FL (US); Barry Hoberman, Coral Springs, FL (US); Kelli White, Lauderdale by the Sea, FL (US); John Gualtieri, Coral Springs, FL (US); Long Hoang, Margate, FL (US)

(73) Assignee: Travelpro International, Inc., Boca Raton, FL (US)

( * ) Notice: Subject to any disclaimer, the term of this patent is extended or adjusted under 35 U.S.C. 154(b) by 28 days.

(21) Appl. No.: 10/278,425

(22) Filed: Oct. 23, 2002

(65) Prior Publication Data

US 2004/0079603 A1 Apr. 29, 2004

(51) Int. Cl.[7] ..... A45C 13/26; A45C 5/14

(52) U.S. Cl. ..... 190/39; 190/18 A; 190/115; 16/113.1; 16/114.1

(58) Field of Search ..... 16/113.1, 114.1; 190/39, 115

(56) References Cited

U.S. PATENT DOCUMENTS 5,249,438 A * 10/1993 Rhaney et al. ..... 62/457.7
5,690,196 A * 11/1997 Wang ..... 190/115
5,934,425 A * 8/1999 Sadow ..... 190/115
5,984,064 A * 11/1999 Byington ..... 190/115
6,301,746 B1 10/2001 Myers et al. ..... 16/113.1
6,317,924 B1 * 11/2001 Gallagher ..... 16/114.1
6,508,344 B1 * 1/2003 Lu ..... 190/115
6,530,459 B1 * 3/2003 Lu ..... 190/115
6,564,426 B1 * 5/2003 Wang ..... 16/113.1
2002/0014382 A1 * 2/2002 Kuo
2002/0050429 A1 * 5/2002 Nykoluk et al.
2003/0132079 A1 * 7/2003 Bellini
2003/0192146 A1 * 10/2003 Chang

* cited by examiner

*Primary Examiner*—Sue A. Weaver
(74) *Attorney, Agent, or Firm*—Sacco & Associates, PA

(57) ABSTRACT

A handle system for a rolling luggage case, including a telescoping post members extensible from a retracted position within a luggage case to an extended position protruding from the luggage case, a cross member extending between adjacent end portions of the telescoping post members, and a handle pivotally mounted to the cross member. A post cap member is attached on an end of the telescoping post member that is distal from the luggage case. The post cap member includes a cylindrical bearing surface to which a handle is pivotally mounted. The cylindrical bearing surface includes a pin reception aperture disposed on a circumference of the cylindrical bearing surface. The cylindrical bearing surface and the pin can be fabricated from a rigid structural material, such as metal.

33 Claims, 4 Drawing Sheets

ADJUSTABLE LUGGAGE HANDLE SYSTEM WITH LOCKING PIN

BACKGROUND

1. Field of the Invention

The invention generally concerns rolling luggage and, more particularly, a pivotably adjustable handle system for rolling luggage that facilitates ergonomic gripping of telescoping handle assemblies commonly used for such rolling luggage.

2. Background of the Invention

Rolling luggage has become increasingly popular in recent years. A common configuration for this type of luggage includes a container or case portion that is generally rectangular in shape in which one or more articles can be stored for travel. The container is typically comprised of a top, bottom, front and back panel, and a pair of sidewalls. A wheel assembly is commonly provided to allow the container to be rolled rather than carried. The wheel assembly generally includes a pair of wheels mounted at an interface of the bottom panel and the back panel of the luggage. The orientation of the wheels defines a rolling direction for the luggage that is orthogonal to the axis of rotation for the wheels.

A telescoping handle assembly is generally provided attached to the back panel and the bottom of the case. The telescoping handle assembly has at least one, and usually two, telescoping posts that can extend from the top panel of the container. A cross-member is generally provided at an end of the telescoping post assembly distal from the container and aligned in a plane that is roughly parallel to the back panel. Configured in this way, the handle assembly provides a gripping surface that is generally oriented transverse to the rolling direction and can therefore be uncomfortable to grip for extended periods of time.

In order to solve the foregoing problem, some newer lines of rolling luggage have begun to incorporate handle systems that include a gripping member that is rotatably oriented in a direction more closely aligned with the luggage rolling direction. A locking mechanism is typically provided for locking the handle in a particular orientation that is preferred by the particular user. This arrangement reduces fatigue and is more comfortable for most users. For example, U.S. Pat. No. 6,301,746 to Myers et al. describes a system that includes a gripping handle that is oriented in this way.

Despite the advantages offered by the newer luggage lines with their improved handle systems, they suffer from several problems. They are somewhat more expensive to manufacture as compared to conventional handle systems due to the added materials and mechanisms associated with rotating and locking the handles in a suitable position for pushing or pulling. They also require special features to accommodate the stowage of the protruding portion of the handle assembly to avoid damaging the assembly during aircraft loading and unloading operations. Accordingly, such handle systems have generally been made available only on more expensive lines of luggage. Further, the improved handle systems have not shown to be particularly well suited to withstand the rigors of common usage. For example, travelers commonly unintentionally cause luggage to make forceful contact with curbs while transporting the luggage to an airport. Moreover, travelers may attempt to lift the luggage by the secondary handle, thereby exerting a moment about the handle's axis of rotation. In some cases, the locking mechanism for the handle cannot withstand shear loads that can be experienced during such usages and damage to the locking mechanism will therefore occur.

SUMMARY OF THE INVENTION

The present invention relates to a handle system for a rolling luggage case. The handle system includes at least one telescoping post member extensible from a retracted position within a luggage case to an extended position protruding from the luggage case. A post cap member is attached on an end of the telescoping post member that is distal from the luggage case. The post cap member includes a cylindrical bearing surface to which a handle is pivotally mounted. The cylindrical bearing surface includes at least one pin reception aperture disposed on a circumference of the cylindrical bearing surface. The cylindrical bearing surface can further include a first radial portion having a first width and a second radial portion having a second width that is narrower than the first width, thereby defining a recess along an edge of the cylindrical bearing surface. A first ridge can be defined at the transition from the first radial portion to the second radial portion. A bearing cap can be provided with a second pin disposed in the recess for engaging the first ridge at a position defining a maximum extension of the handle. Further, the second pin can engage a second ridge at a second transition between the first radial portion and the second radial portion to define a storage position for the handle.

The handle includes at least one pin moveable between a locked position wherein the pin inserts into the pin reception aperture and an unlocked position wherein the pin is retracted from the pin reception aperture. The handle can rotate about the cylindrical bearing surface when the pin is in the unlocked position and the handle is fixed relative to the cylindrical bearing surface when the pin is in the locked position. Notably, the pin and the portion of the bearing surface engaging the pin can be fabricated from a rigid structural material resistant to shear loads, such as metal or a composite material, while other handle system components should be made of a lightweight material, such as plastic. Accordingly, the handle system can be lightweight, yet durable to withstand the rigors of common usage.

The handle can include a U-shaped portion and a grasping bar having a gripping area ergonomically formed for grasping. A button actuator operatively connected to the pin also can be provided to move the pin between the locked position and the unlocked position. The button actuator can be disposed on the U-shaped portion opposed from a junction of the grasping bar with the U-shaped portion. Further, the button actuator can be coaxially aligned to the grasping bar and/or disposed at an end of the grasping bar distal from the end portions of the telescoping post members.

The handle can be disposed in a plurality of positions with respect to the cross member. For example, the handle can be locked in positions parallel to the first and second telescoping post members, such as in a retracted position where the handle is disposed between the post members or in an extended position where the handle extends from the post members. Further, the handle system also can be locked at a variety of angles relative to the first and second telescoping post members, for example 90°, 110°, 160°, or any other angle.

DETAILED DESCRIPTION

Figure 1:
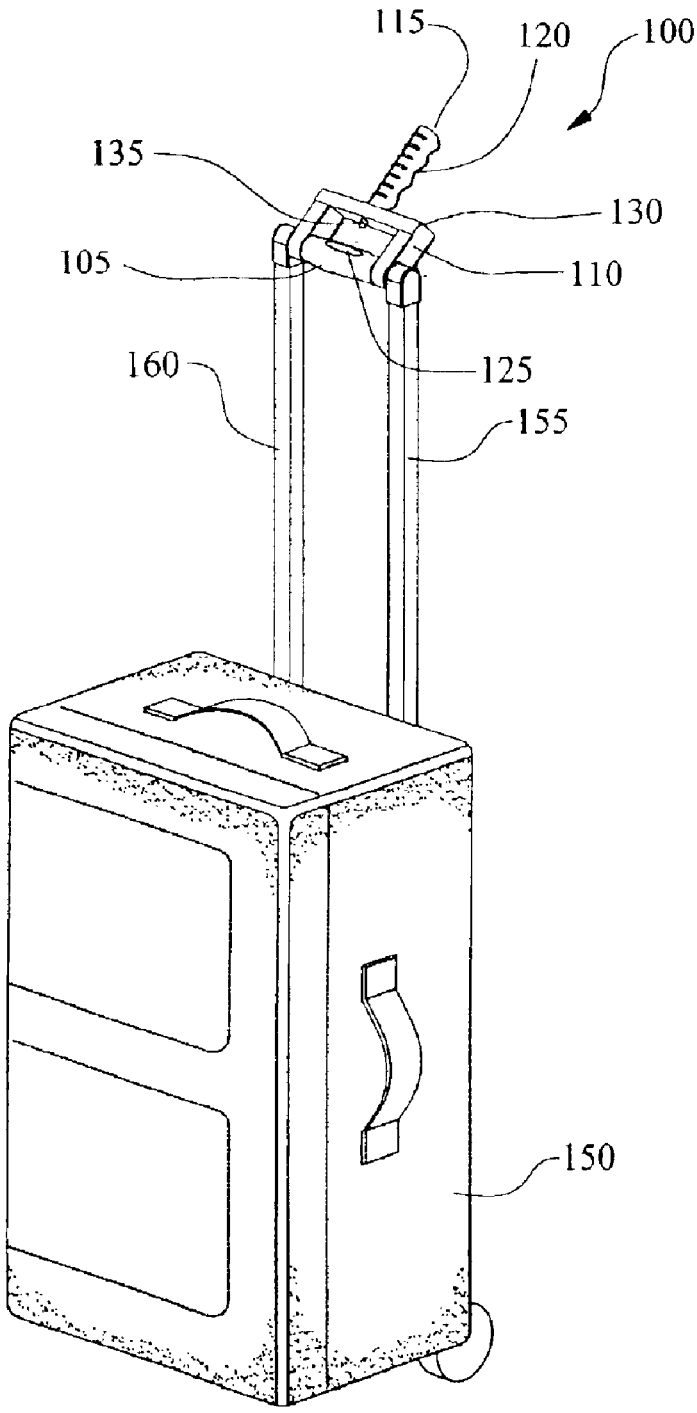
FIG. 1*a* is a perspective view an adjustable handle system attached to an article of rolling luggage in accordance with the present invention.

An exemplary embodiment of an adjustable handle system 100 attached to a rolling luggage case 150 is shown in FIG. 1. The handle system 100 includes at least one, and preferably two, telescoping post members 155 and 160, which are extensible from a retracted position within the luggage case 150 to an extended position protruding from the luggage case 150. The handle system 100 also includes a cross member 105 extending between adjacent end portions of the telescoping post members 155 and 160 and a handle 110 pivotably attached to the cross member 105. A telescoping activation button 125 can be provided on the cross member 105 which, when depressed, can facilitate operation of the telescoping post members 155 and 160 between the retracted position and the extended position.

The handle 110 can include a generally U-shaped portion 130 to which a grasping bar 115 can be attached. The grasping bar 115 can be disposed at a central location on the U-shaped portion 130, extending from the U-shaped portion away from the cross member 105. Notably, the grasping bar 115 can include a gripping area 120 ergonomically formed for grasping.

A button actuator 135 also can be provided on the handle 110. In one arrangement, the button actuator 135 is disposed on the U-shaped portion 130. For example, the button actuator 135 can be coaxially aligned to the grasping bar 115 and disposed on the U-shaped portion opposed from a junction of the grasping bar 115 with the U-shaped portion. In another arrangement, the button actuator 135 is disposed at an end of the grasping bar 115 distal from the U-shaped portion 130. Still, the invention is not so limited as the button actuator 135 can be located elsewhere on the handle system 100.

Figure 2A:
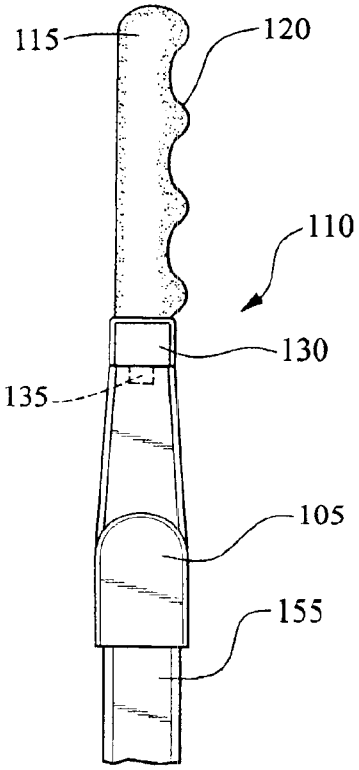
FIGS. 2*a*–2*c* are a series of side views showing different positions in which the adjustable handle system can be disposed in accordance with the present invention.
Figure 2B:
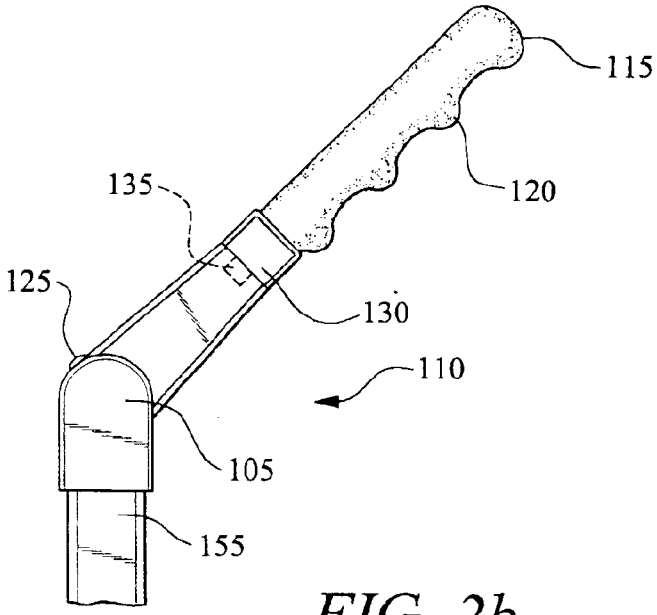
Figure 2C:
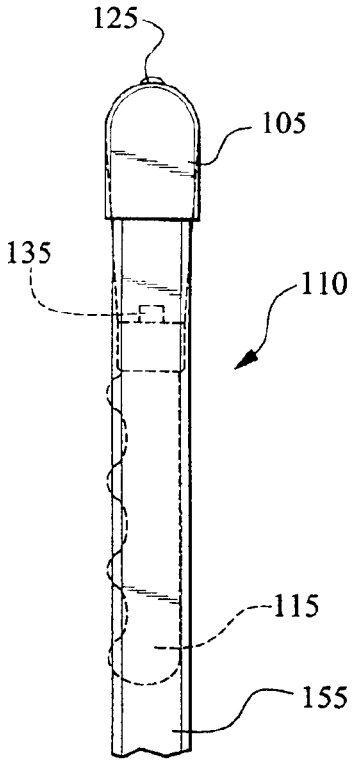

When depressed, the button actuator 135 can facilitate rotation of the handle 110 about the cross member 105. Upon release of the button actuator 135, the handle 110 can be locked into a selected position. FIGS. 2*a*–2*c* are a series of side views showing different positions in which the handle 110 can be disposed. FIG. 2*a* shows one arrangement of the handle in a position of maximum extension. In the arrangement shown, the handle is disposed at an angle approximately 180° relative to the telescoping post member 155. In another arrangement, the position of maximum extension of the handle can be at an angle approximately 135° relative to the telescoping cost member 155, as shown in FIG. 2*b*. The invention is not so limited, however, and the position of maximum extension can be selected to be an angle relative to the telescoping post member 155. Further, the adjustable hand system 100 also can be provided with a plurality of additional selectable handle positions so that the handle 110 can be disposed at a plurality of positions relative to the telescoping post member 155, for example at an angle of 110° and/or at any other angle. In particular, angles of 160°, 110° and 90° provide comfortable positions for pushing and pulling a rolling luggage case. Other notable positions are 115° and 140°. Importantly, a selectable handle position can be provided herein the handle 110 is parallel to, and disposed between, telescoping post members 155 and 160, as shown in FIG. 2*c*. This arrangement is particularly useful for storing the handle assembly 100 within the luggage case 150 when the telescoping post members 155 and 160 are in the retracted position.

Figure 3:
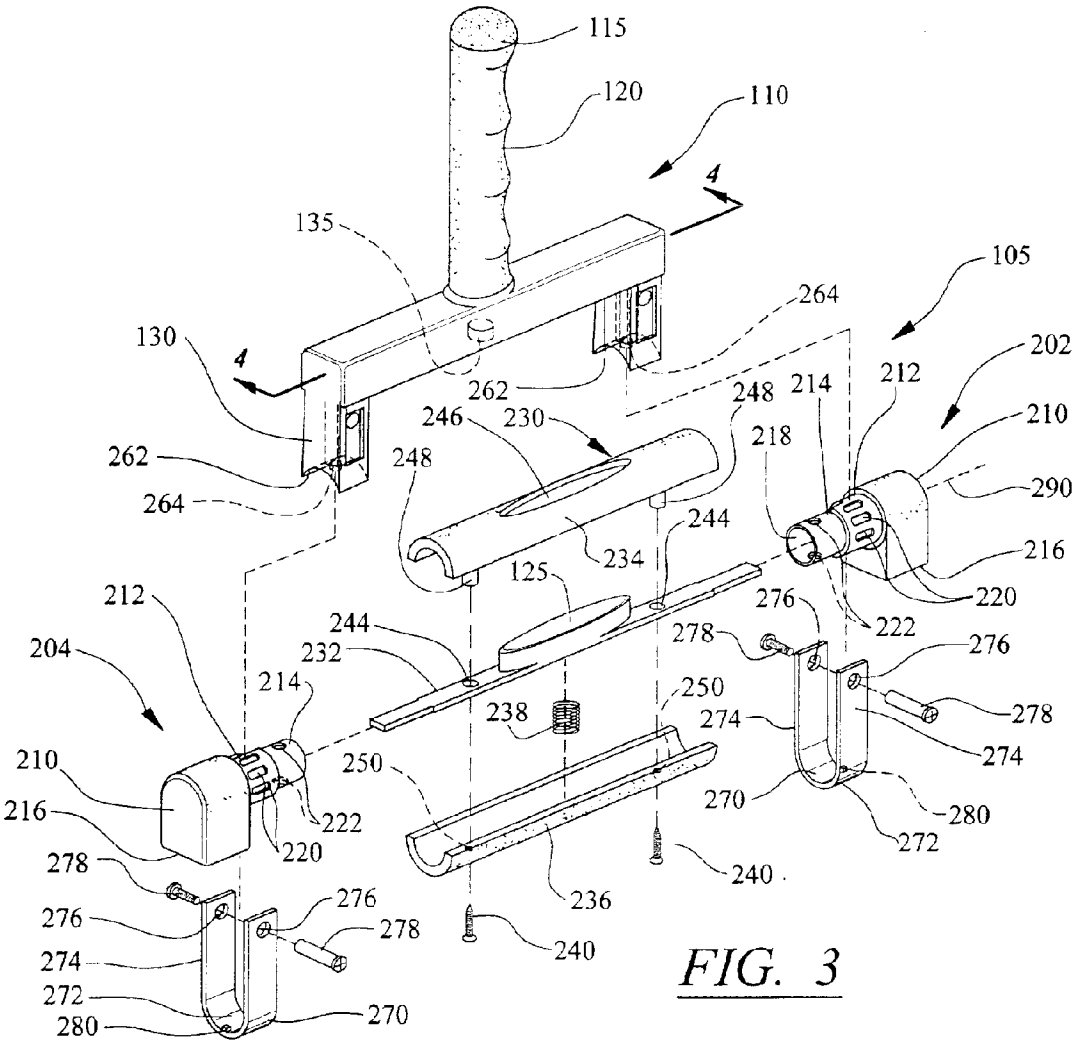
FIG. 3 is an exploded view of the adjustable handle system of FIG. 1 in accordance with the present invention.

Referring to FIG. 3, the cross member 105 can include two post cap members 202 and 204 and a central member 230 centrally located between the post cap members 202 and 204. The post cap members 202 and 204 each can include a post receiving portion 210, a cylindrical bearing surface 212, and a substantially cylindrical tube 214 engaging the central member 230. Further, each tube 214 can include a hollow portion 218 which is coaxial with a respective cylindrical bearing surface 212. As defined herein, substantially cylindrical means those shapes that are roughly cylindrical in shape.

Each post receiving portion 210 can be adjacent to, and extend outwardly from, the cylindrical bearing surface 212. Notably, the post receiving portions 210 can be fixed to the respective cylindrical bearing surfaces 212 to constrain the cylindrical bearing surfaces 212 against rotational movement. Further, each post receiving portion 210 can include an aperture 216 for receiving the first and second telescoping post members 155 and 160. The apertures 216 can be any shape that can be used to engage the telescoping post members. For example, if the telescoping post members 155 and 160 are cylindrical in shape, the apertures 216 can be cylindrical. If the telescoping post members 155 and 160 have square cross sections, the apertures 216 can be square. In one arrangement, the orientation of the apertures 216 can be substantially perpendicular to a central axis 290 of the cylindrical bearing surface 212. As defined herein, substantially perpendicular means an orientation that is either perpendicular or nearly perpendicular. Other aperture orientations can be implemented, however. For example, an aperture on a first post cap member can be oriented at an angle of 110° while an aperture on a second post cap member is oriented at an angle of 70°. Still, a myriad of other aperture orientations can be implemented so long as the handle 110 can pivot about the cross member 105.

The outer diameter of each tube 214 can be smaller than the diameter of the cylindrical bearing surface 212, thereby enabling the tube 214 to extend from the post receiving portion 210 inwardly through the cylindrical bearing surface 212 to engage central member 230. Accordingly, each cylindrical bearing surface 212 is disposed between the respective tube 214 and post receiving portion 210. In one arrangement, each cylindrical bearing surface 212 and the respective tube 214 can be fabricated at least in part from a common structure. For example, the tube 214 and at least a portion of the cylindrical bearing surface 212 can be fabricated from a single piece of rigid structural material resistant to shear loads, such as metal or a composite material. Further, each cylindrical bearing surface 212 can include a plurality of pin reception apertures 220 and each tube 214 can include two alignment apertures 222, both of which are discussed further below.

The central member 230 can include a post unlocking member 232, a top grip portion 234, a bottom grip portion 236, a spring 238, and screws 240. In the preferred embodiment, the post unlocking member 232, the top grip portion 234, and the bottom grip portion 236 are made of a lightweight material, for example plastic or a composite material. The post unlocking member 232 can be elongate and further include two alignment apertures 244 and the telescoping activation button 125. The telescoping activation button 125 can be centrally disposed on an upper surface of the post unlocking member 232. The top grip portion 234 can include an unlocking button aperture 246 aligned with the telescoping activation button 125 and two alignment posts 248 aligned with respective alignment apertures 244. Lastly, the bottom grip portion 236 can include screw holes 250 aligned with the alignment apertures 244.

When the cross member 105 is assembled, respective ends of the post unlocking member 232 can insert through the hollow portion 218 of each tube 214 and extend into the respective apertures 216 in the post receiving portions 210. Accordingly, the post unlocking member 232 can engage a telescoping activation mechanism disposed on an end of at least one of the telescoping post members 155 and 160 to operate the telescoping post members 155 and 160 between the extensible and the retracted positions.

The top grip portion 234 can be disposed so that the alignment posts 248 each insert through respective alignment apertures 222 of the tubes 214 and alignment apertures 244 of the post unlocking member 232. The bottom grip portion 236 then can be attached to the top grip portion 234 to define a gripping area ergonomically formed for grasping. For example, the bottom grip portion 236 can be attached to the top grip portion 234 by screwing screws 240 through the screw holes 250 and into the alignment posts 248. Notably, the top grip portion 234 and the bottom grip portion 236 extend between junctions of each tube 214 and the respective cylindrical bearing surface 212. Accordingly, each cylindrical bearing surface 212 can be disposed between a respective post receiving portion 210 and grip portions 234 and 236 of the central member 230, thereby defining a bearing channel therebetween. Further, the spring 238 can be disposed between the bottom grip portion 236 and the post unlocking member 232 to keep the post unlocking member 232 normally disposed proximate to the top grip portion 234. The spring 238 also can return the post unlocking member 232 to the normally disposed position after the telescoping activation button 125 has been depressed to facilitate operation of the telescoping post members 155 and 160.

The U-shaped portion 130 can include two ends each having an arcuate handle seat 262 and a pin 264. In a preferred arrangement, the U-shaped portion 130 and the grasping bar 115 are fabricated from a lightweight material, such as plastic or a composite material. Other materials can be used, however, for example metal. Further, the button actuator 135 can be operatively connected to the pins 264 to move the pins 264 between an extended (locked) position and a retracted (unlocked) position. At least one spring (not shown) can be provided to keep the button actuator 135 normally disposed with the pins 264 in the extended position and return the button actuator 135 to the normally disposed position after the button actuator 135 has been depressed. Still, other pin arrangements can be provided and the present invention is not so limited.

The handle 110 can be pivotally mounted to the cross member 105 with the arcuate handle seats 262 rotatably supported (journaled) on respective cylindrical bearing surfaces 212. Bearing caps, for example U-strap 270, can be disposed to mount the handle 110 to the cross member 105. Fasteners 278 can be inserted through apertures 276 in each U-strap 270 and through correlating apertures in the U-shaped portion 130, thereby securing the U-straps 270 to the handle 110. Each U-strap 270 can include an arcuate portion 272 and two linear potions 274 extending from the arcuate portion. Each U-strap 270 can be disposed with the arcuate portion 272 in opposition to the respective arcuate handle seats 262 and with the linear portions 274 being affixed to respective sides of the U-shaped portion 30. Accordingly, each arcuate handle seat 262 can be constrained for rotational movement about a respective cylindrical bearing surface 212.

When the pins 264 are in the retracted, unlocked position, the handle 110 is free rotate about the cross member 105. In the extended, locked position, however, the pins 264 insert into respective pin reception apertures 220 to prevent rotation of the handle 110. In the locked position, the pins 264 and the pin reception apertures 220 can experience high levels of shear force. Accordingly, the pins 264 and a portion of the cylindrical bearing surface 212 having pin reception apertures 220 should be manufactured from a material resistant to shear loads, such as metal or a composite material. In one arrangement, the portion of the cylindrical bearing surface 212 having pin reception apertures 220 can be fabricated of metal while a remaining portion of the cylindrical bearing surface 212 can be fabricated of plastic. Accordingly, the handle system can be lightweight, yet durable to withstand the rigors of common usage.

In operation, the button actuator 135 can be depressed to move the pins 264 into the unlocked position to enable rotation of the handle 110 about the cross member 105. When the button actuator 135 is released, spring force applied to the button actuator 135 and/or pins 264 can move the pins 264 into pin reception apertures 220 when the pins 264 and the pin reception apertures 220 become aligned. Each U-strap 270 further can include a second pin 280.

Figure 4:
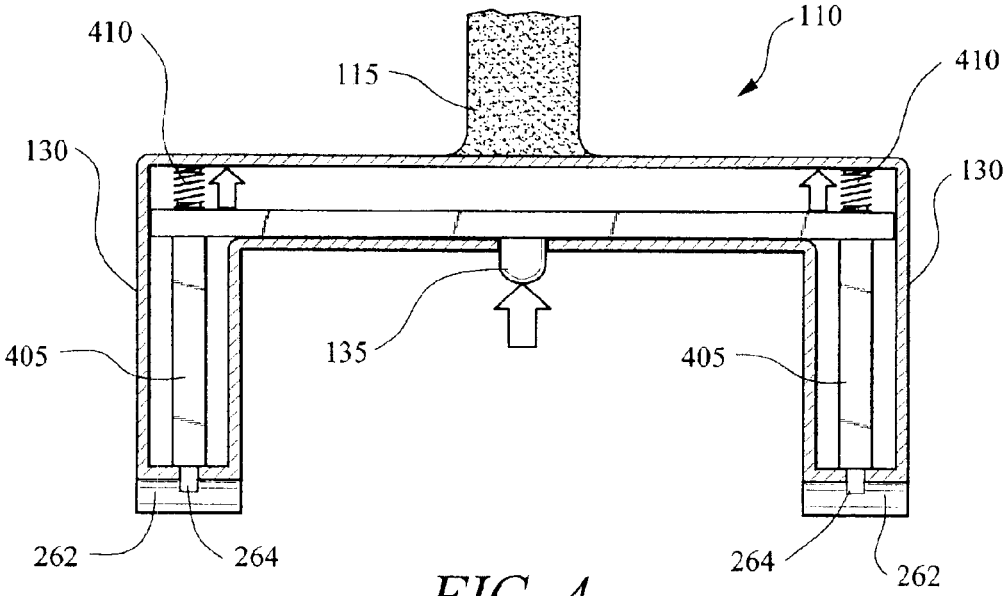
FIG. 4 is a section view taken along section line 4—4 of the handle U-shaped portion of FIG. 3 in accordance with the present invention.

FIG. 4 is a section view of the U-shaped portion 130 of FIG. 3 taken along section line 4—4. FIG. 4 shows an exemplary arrangement wherein the button actuator 135 is operatively connected to the pins 264. For example, the button actuator 135 and the pins 264 can be coupled to an internal U-shaped internal structure 405. Springs 410 can be provided to apply spring force to the U-shaped internal structure 405 to maintain the pins 264 in the locked position when the button actuator 135 is not being depressed.

Figure 5:
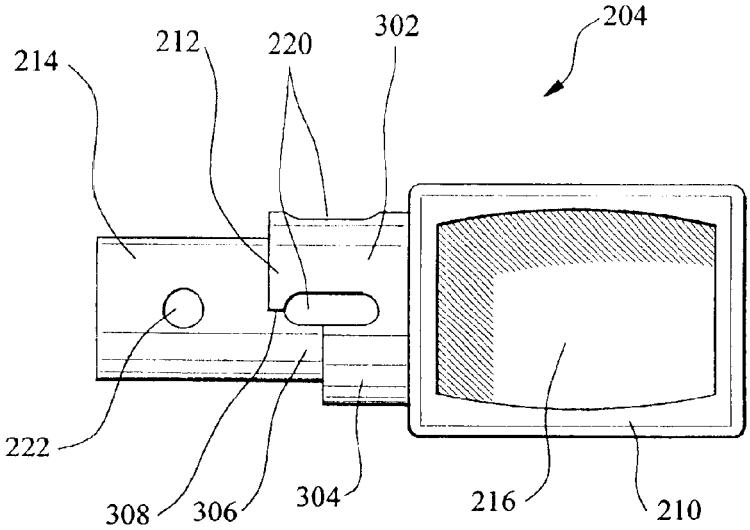
FIG. 5 is a bottom view of a handle post cap member having a cylindrical bearing surface in accordance with the present invention.

Referring to FIG. 5, a first radial portion 302 of the cylindrical bearing surface 212 can have a greater width than a second radial portion 304 of the cylindrical bearing surface 212. Accordingly, a recess 306 in the cylindrical bearing surface is thereby defined proximate to the second portion 304. Further, a first ridge 308 at a first transition from the second radial portion 304 to the first radial portion 302 is defined as well. The second pin 280 can be disposed to be moveable in the recess 306 and engage the first ridge 308 at a position defining a maximum extension of the handle 110. Further, a second ridge (not shown) can be located at a second transition from the second portion 304 to the first portion 302. The second pin 280 can be disposed to engage the second ridge at a position defining a minimum extension, or storage position, of the handle 110.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising at least one cylindrical bearing surface, said cylindrical bearing surface having a radius and at least one width parallel to a central axis of said cylindrical bearing surface, at least one pin aperture disposed on a circumference of said cylindrical bearing surface for receiving a pin and a recess defined along an edge of said cylindrical bearing surface and a first ridge defined at an end of said recess;

a handle having a handle seat journaled on said cylindrical bearing surface and having at least a first pin moveable between a locked position within said at least one pin aperture and an unlocked position retracted from said aperture, said handle being rotatable about said cylindrical bearing surface when said first pin is in said unlocked position, and said handle being fixed relative to cross member when said first pin is in said locked position; and a second pin disposed in said recess that engages said first ridge at a position defining a maximum rotation of said handle.

2. The handle system according to claim 1 wherein a first radial portion of said cylindrical bearing surface has first width and a second radial portion of said cylindrical bearing surface has a second width, said second width being narrower than said first width, thereby defining said recess.

3. The handle system according to claim 2 wherein said first ridge is defined at a first transition from said second radial portion to said first radial portion.

4. The handle system according to claim 3 further comprising a bearing cap, said bearing cap comprising an arcuate portion and being disposed with said arcuate portion in opposition to said handle seat, thereby maintaining said handle seat rotatably supported against said cylindrical bearing surface.

5. The handle system according to claim 1 wherein at least a portion of said cylindrical bearing surface and said pin are made of a rigid structure material resistant to shear loads.

6. The handle system according to claim 5 wherein said rigid structural material is metal.

7. The handle system according to claim 1 wherein said post cap member is comprised of a post receiving portion extending from said cylindrical bearing surface and configured for attachment to said telescoping post member.

8. The handle system according to claim 1 wherein said handle further comprises a grasping bar having a gripping area ergonomically formed for grasping.

9. The handle system according to claim 8 further comprising a button actuator operatively connected to said pin to may said pin between said locked position and said unlocked position.

10. The handle system according to claim 9 wherein said button actuator is disposed at an end of said grasping bar distal from said end of said at least one telescoping post members.

11. The handle system according to claim 1 wherein said cylindrical bearing surface is constrained against rotational movement relative to said post cap member.

12. The handle system according to claim 1 further comprising a central member centrally positioned on said handle wherein said cylindrical bearing surface is disposed between said end of said telescoping post member and said central member and said bearing surface defines a channel in which said handle seat is constrained for rotational movement about said bearing surface.

13. The handle system according to claim 12 wherein said central member comprises a gripping area ergonomically formed for grasping.

14. The handle system according to claim 1 further comprising a plurality of said pin reception apertures disposed on said circumference of said cylindrical bearing surface, for selectively locking said handle in any one of plurality of positions.

15. The handle system according to claim 14 wherein one of said positions locks said handle parallel to said telescoping post member.

16. The handle system according to claim 14 wherein one of said positions locks said handle substantially parallel to, and extended from, said telescoping post member.

17. The handle system according to claim 1, wherein said pin is retained within said handle in said unlocked position.

18. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising at least one cylindrical bearing surface, said cylindrical bearing surface having a least one pin aperture disposed on a circumference of said cylindrical bearing surface for receiving a pin, said cylindrical bearing surface further comprising a first radial portion having a first width and a second radial portion having a second width, said second width being narrower than said first width, thereby defining a recess along an edge of said cylindrical bearing surface and defining a first ridge at a first transition from said second radial portion to said first radial portion;

a handle having a handle seat journaled on said cylindrical bearing surface and having at least a first pin moveable between a locked position within said at least one pin aperture and an unlocked position retracted from said aperture, said handle being rotatable about said cylindrical bearing surface when said first pin is in said unlocked position, and said handle being fixed relative to cross member when said first pin is in said locked position;

a bearing cap, said bearing cap comprising an arcuate portion and being disposed with said arcuate portion in opposition to said handle seat, thereby maintaining said handle seat rotatably supported against said cylindrical bearing surface;

wherein said bearing cap further comprises a second pin disposed in said recess for engaging said first ridge at a position defining a maximum rotation of said handle.

19. The handle system according to claim 18 wherein maximum extension of said handle is at an angle between about 135 degrees and 180 degrees relative to said telescoping post member.

20. The handle system according to claim 18 further comprising a second ridge at a second transition from said second radial portion to said first radial portion, said second pin engaging said second ridge at a position defining storage position for said handle.

21. The handle system according to claim 20, wherein said storage position is a position wherein a length of said handle is substantially adjacent and coextensive with a length of said telescoping post member.

22. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising at least one cylindrical bearing surface, said cylindrical bearing surface having a least one pin aperture disposed on a circumference of said cylindrical bearing surface for receiving a pin, said cylindrical bearing surface further comprising a first radial portion having a first width and a second radial portion having a second width, said second width being narrower than said first width, thereby defining a recess along an edge of said cylindrical bearing surface and defining a first ridge at a first transition from said second radial portion to said first radial portion;

a handle having a handle seat journaled on said cylindrical bearing surface and having at least one pin moveable between a locked position within said at least one pin aperture and an unlocked position refracted from said aperture, said handle being rotatable about said cylindrical bearing surface when said pin is in said unlocked position, and said handle being fixed relative to cross member when said pin is in said locked position;

a bearing cap, said bearing cap comprising an arcuate portion and being disposed with said arcuate portion in opposition to said handle seat, thereby maintaining said handle seat rotatably supported against said cylindrical bearing surface;

wherein said bearing cap is a U-strap, said U-strap comprising said arcuate portion and a linear portion extending from each of two edge of said arcuate portion.

23. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising:

at least one cylindrical bearing surface, said cylindrical bearing surface having a radius and at least one width parallel to central axis of said cylindrical bearing surface, and at least one pin aperture disposed on a circumference of said cylindrical bearing surface for receiving a pin; and a post receiving portion extending from said cylindrical bearing surface and configured for attachment to said telescoping post member;

a handle having a handle seat journaled on said cylindrical bearing surface and having at least one pin moveable between a locked position within said at least one pin aperture and an unlocked position retracted from said aperture, said handle being rotatable about said cylindrical bearing surface when said pin is in said unlocked position, and said handle being fixed relative to cross member when said pin is in said locked position; and a substantially cylindrical tube coaxial with said cylindrical bearing a surface and extending from said post receiving portion beyond said cylindrical bearing a surface, said tube having a smaller outer diameter than said cylindrical bearing surface.

24. A handle system for a rolling luggage case, comprising:

a plurality of telescoping post members extensible from a retracted position within a luggage case to an extended position protruding from said luggage case;

a post cap member attached on an end of each of said plurality of telescoping post members distal from said luggage case, said post cap member comprising at least one cylindrical bearing surface, said cylindrical bearing surface having a radius and at least one width parallel to a central axis of said cylindrical bearing surface, at least one pin aperture disposed on a circumference of said cylindrical bearing surface for receiving a pin;

a handle having an arcuate handle seat journaled on said cylindrical bearing surface and having at least one pin moveable between a locked position within said at least one pin aperture and an unlocked position retracted from said aperture, said handle being rotatable about said cylindrical bearing surface when said pin is in said unlocked position, and said handle being fixed relative to cross member when said pin is in said locked position, wherein said at least one pin is extensible from said handle seat; and a U-shaped portion extending from said cylindrical bearing surface.

25. The handle system according to claim 24 further comprising a button actuator disposed on said U-shaped portion and operatively connected to said pin to move said pin between said locked position and said unlocked position.

26. The handle system according to claim 24, further comprising a U-shaped strap cooperatively engaging said handle such that said arcuate handle seat and said U-shaped strap enclose said circumference of said bearing surface.

27. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising at least one cylindrical bearing surface, said cylindrical bearing surface having a radius and at least one width parallel to a central axis of said cylindrical bearing surface, and at least one pin aperture disposed on a circumference of said cylindrical bearing surface for receiving a pin; and a handle having a U-shaped portion comprising legs terminating with concave handle seat journaled on said cylindrical bearing surface and having at least one pin moveable between a locked position within said at least one pin aperture and an unlocked position retracted from said aperture, said handle being rotatable about said cylindrical bearing surface when said pin is in said unlocked position, and said handle being fixed relative to cross member when said pin is in said locked position, said handle further comprising:

a grasping bar rigidly attached to said U-shaped portion, said grasping bar having a gripping area ergonomically formed for grasping.

28. The handle system according to claim 27 further comprising a button actuator disposed at an end of said grasping bar distal from said U-shaped portion, said button operatively connected to said pin to move said pin between said locked position and said unlocked position.

29. The handle system according to claim 27 further comprising a button actuator disposed on said U-shaped portion opposed from a junction of said grasping bar with said U-shaped portion, said button operatively connected to said pin to move said pin between said locked position and said unlocked position.

30. The handle system according to claim 29 wherein said button actuator is coaxially aligned with said grasping bar.

31. The handle system according to claim 27, further comprising a U-shaped strap cooperatively engaging said handle such that said arcuate handle seat and said U-shaped strap enclose said circumference of said bearing surface.

32. The handle system according to claim 27, wherein said central axis said cylindrical bearing surface is substantially perpendicular to said at least one moveable pin.

33. A handle system for a rolling luggage case, comprising:

at least one telescoping post member extensible from a retracted position within a luggage case to an extended position protruding from said luggage case;

a post cap member attached on an end of said telescoping post member distal from said luggage case, said post cap member comprising at least one cylindrical bearing surface, said cylindrical bearing surface having a radius and at least one width parallel to a central axis of said cylindrical bearing surface, and at least one pin aperture disposed on a circumference of said cylindrical bearing surface for receiving a pin; and a handle having a handle seat journaled on said cylindrical bearing surface and having at least one pin moveable between a locked position within said at least one pin aperture and an unlocked position retracted from said aperture, said handle being rotatable about said cylindrical bearing surface when said pin is in said unlocked position, and said handle being fixed relative to cross member when said pin is in said locked position;

a central member comprising a gripping area ergonomically formed for grasping, said central member centrally positioned on said handle wherein said cylindrical bearing surface is disposed between said end of said telescoping post member and said central member and said bearing surface defines a channel in which said handle seat is constrained for rotational movement about said bearing surface;

a telescoping activation button disposed at a central position on said central member; and a post unlocking member extending from said telescoping post member to at least said telescoping activation button;

wherein said post unlocking member engages a telescoping activation mechanism disposed on an end said telescoping post member to operate said post members between said extensible and said retracted positions when said telescoping activation button is depressed.

* * * * *

UNITED STATES PATENT AND TRADEMARK OFFICE

CERTIFICATE OF CORRECTION

PATENT NO. : 6,874,604 B2
DATED : April 5, 2005
INVENTOR(S) : Miller et al.

It is certified that error appears in the above-identified patent and that said Letters Patent is hereby corrected as shown below:

Column 3,
Line 58, delete “cost” and replace with -- post --.
Line 60, delete “an” and replace with -- any --.
Line 62, delete “hand” and replace with -- handle --.

Column 4,
Line 3, delete “herein” and replace with -- wherein --.

Column 5,
Line 60, delete “strap” and replace with -- straps --.
Line 66, delete “potions” and replace with -- portions --.

Column 6,
Line 3, delete “30” and replace with -- 130 --.

Column 8,
Line 22, delete “a” and replace with -- at --.

Column 9,
Line 4, delete “a” and replace with -- at --.
Line 17, delete “refracted” and replace with -- retracted --.
Line 29, delete “edge” and replace with -- ends --.

Column 11,
Line 4, insert -- of -- between “axis” and “said”.

Signed and Sealed this

Twentieth Day of December, 2005

JON W. DUDAS
*Director of the United States Patent and Trademark Office*